United States Patent [19]

Takegawa

[11] Patent Number: 4,830,063

[45] Date of Patent: May 16, 1989

[54] PICKING CONTROLLER FOR AN AIR JET LOOM

[75] Inventor: Yujiro Takegawa, Ishikawa, Japan

[73] Assignee: Tsudakoma Corporation, Kanazawa, Japan

[21] Appl. No.: 149,736

[22] Filed: Jan. 29, 1988

[30] Foreign Application Priority Data

Jan. 30, 1987 [JP] Japan ..... 62-021239

[51] Int. Cl.[4] ..... D03D 47/36

[52] U.S. Cl. ..... 139/435; 139/452

[58] Field of Search ..... 139/435, 452

[56] References Cited

U.S. PATENT DOCUMENTS

| | | | |
|---|---|---|---|
| 4,658,865 | 4/1987 | Gotoh | 139/435 |
| 4,673,004 | 6/1987 | Rosseel et al. | 139/435 |
| 4,716,941 | 1/1988 | Takegawa | 139/435 X |
| 4,732,179 | 3/1988 | Takegawa | 139/435 |
| 4,744,393 | 5/1988 | Takegawa | 139/435 X |
| 4,759,392 | 7/1988 | Van Bogaert et al. | 139/435 |

FOREIGN PATENT DOCUMENTS

| | | |
|---|---|---|
| 60-110952 | 6/1985 | Japan . |
| 60-162838 | 8/1985 | Japan . |

*Primary Examiner*—Andrew M. Falik

*Attorney, Agent, or Firm*—Wenderoth, Lind & Ponack

[57] ABSTRACT

A picking controller for an air jet loom having a main picking nozzle which jets air to pick a weft yarn into a shed, and groups of subnozzles which jet air to help the picked weft yarn run along a picking path, includes a phase angle detector for detecting the phase angle of the air jet loom and a weft yarn arrival detector for detecting the arrival of the free end of the picked weft yarn at an arrival position. It also includes a memory for storing actual arrival phase angles of the picked weft yarns with respect to the phase angle of the air jet loom and a variation detector for determining arrival phase angle variations. A comparator compares the phase angle variations with a predetermined target phase angle variation and provides a signal representing the result of the comparison. A picking condition setting unit sequentially varies the picking condition of the groups of subnozzles according to the signal from the comparator representing the result of comparison. A control unit controls the picking condition of the groups of subnozzles according to a command from the picking condition setting unit and an arithmetic unit determines the correlation between picking condition and arrival phase angle on the basis of the actual arrival phase angle variations, and then determines a picking condition corresponding to the target arrival phase angle variation on the basis of the correlation between picking condition and arrival phase angle.

3 Claims, 2 Drawing Sheets

PICKING CONTROLLER FOR AN AIR JET LOOM

BACKGROUND OF THE INVENTION

1. Field of the Invention

The present invention relates generally to an air jet loom and, more particularly, to a picking controller for an air jet loom, for automatically controlling picking conditions for groups of subnozzles, such as jet pressure and jet duration, so as to be at optimum values.

2. Related Art

An air jet loom is provided, for picking a operation, with a main picking nozzle and groups of subnozzles. The main picking nozzle is disposed near a selvedge of a fabric on the picking side of the air jet loom mainly to drive a weft yarn at an initial running speed, and the groups of subnozzles are arranged along the running path of a weft yarn to help the picked weft yarn run further and to regulate the dynamic position of the picked weft yarn.

The jet pressure of the subnozzles more directly influences the running mode of the picked weft yarn than that of the main picking nozzle. For example, when the jet pressure of the subnozzle is insufficient, the picked weft yarn meanders unstably and is unable to extend properly along the running path, because the subnozzles are unable to apply a sufficient conveying force to the picked weft yarn. Consequently, a bent pick or a kinky filling results, and an arrival phase angle of the crankshaft of the loom at which the picked weft yarn arrives at an arriving position varies between picking cycles.

Under such circumstances, it has been a usual practice to set the jet pressure of the subnozzle at a value higher than that considered to be appropriate to secure stable running of the picked weft yarn in anticipation of the variation of the shape of a supply package and the variation of the physical properties of the weft yarn. Accordingly, the conventional air jet loom consumes an unnecessarily large amount of compressed air.

For example, an invention disclosed in Japanese Laid-Open Patent Publication No. 60-110952 simultaneously controls both the jet pressure of the main picking nozzle and that of the subnozzles so as to maintain the jet pressure of the main picking nozzle and that of the subnozzles in a fixed relationship, to thereby regulate the running time of the picked weft yarn so as to occur at a fixed time. However, the influence of variations in the condition of the running path, such as soiling of the reed, on the running mode of the picked weft yarn can be cancelled simply by controlling the jet pressure of the subnozzles. Nevertheless, this prior art invention necessarily changes the jet pressure of the main picking nozzle simultaneously with the jet pressure of the subnozzles so as to thereby waste compressed air, which is undesirable in view of saving energy.

An invention disclosed in Japanese Laid-Open Patent Publication No. 60-162838 measures the running speed of a picked weft yarn indirectly through the detection of variations in the amount of a stored weft yarn, and automatically controls the respective jet pressures and respective jet timings of the main picking nozzle and the subnozzles on the basis of the indirectly measured running speed of the weft yarn. However, a detector provided on the picking side is unable to accurately detect the running mode of the picked weft yarn, particularly, the dynamic position of the picked weft yarn. Accordingly, this prior art invention also is incapable of accurately controlling the jet pressure of the subnozzles.

SUMMARY OF THE INVENTION

Accordingly, it is an object of the present invention to insure a stable picking operation and to prevent wasting compressed air by the subnozzles by indirectly observing the dynamic position of picked weft yarns on the basis of variations in arrival time of picked weft yarns between picking cycles, and by controlling the dynamic position of the picked weft yarn through the individual adjustment of the picking condition of the groups of subnozzles, such as jet pressure, so that the variations in arrival time are reduced to a target value.

To achieve the object of the invention, a picking controller according to the present invention determines a target arrival phase angle variation, and positively changes the jet pressure or jet duration of the subnozzles during a weaving operation, and detects the variation of the picking condition sequentially, and determines an optimum picking condition with respect to the target variation on the basis of the correlation between the picking condition and the target arrival phase angle variation, and thereafter controls the subnozzles according to the thus determined optimum picking condition.

This picking controller controls the jet pressure of the groups of subnozzles so as to be at the minimum value for stabilizing the running mode, particularly, the dynamic position of the weft yarn, so that the wasteful consumption of compressed air is obviated and a stable picking operation is carried out.

According to the present invention, the running mode of a picked weft yarn, namely, the dynamic position of a picked weft yarn, which is dependent on the jetting condition of the subnozzles, is detected through the detection of variations in the weft yarn arrival phase angle. A picking condition, such as a jet pressure of the subnozzles corresponding to the target variation is calculated and adjusted automatically, and hence the picking condition of the subnozzles is maintained at the minimum necessary picking condition. Accordingly, the present invention is far more effective for reducing the consumption of compressed air than the prior art, which determines the jet pressure of the subnozzles in anticipation of the variation of weft yarn supplying conditions.

Furthermore, the picking condition of the subnozzles is changed positively during the control process and an optimum picking condition meeting the target variation is determined through calculation during the picking the picking condition changing process, and hence the response speed of the control operation of the picking controller of the present invention is higher than that of the ordinary variable-value control operation.

The above objects, features and advantages of the present invention will become more apparent from the following description taken in conjunction with the accompanying drawings.

DETAILED DESCRIPTION OF THE PREFERRED EMBODIMENT

Figure 1:
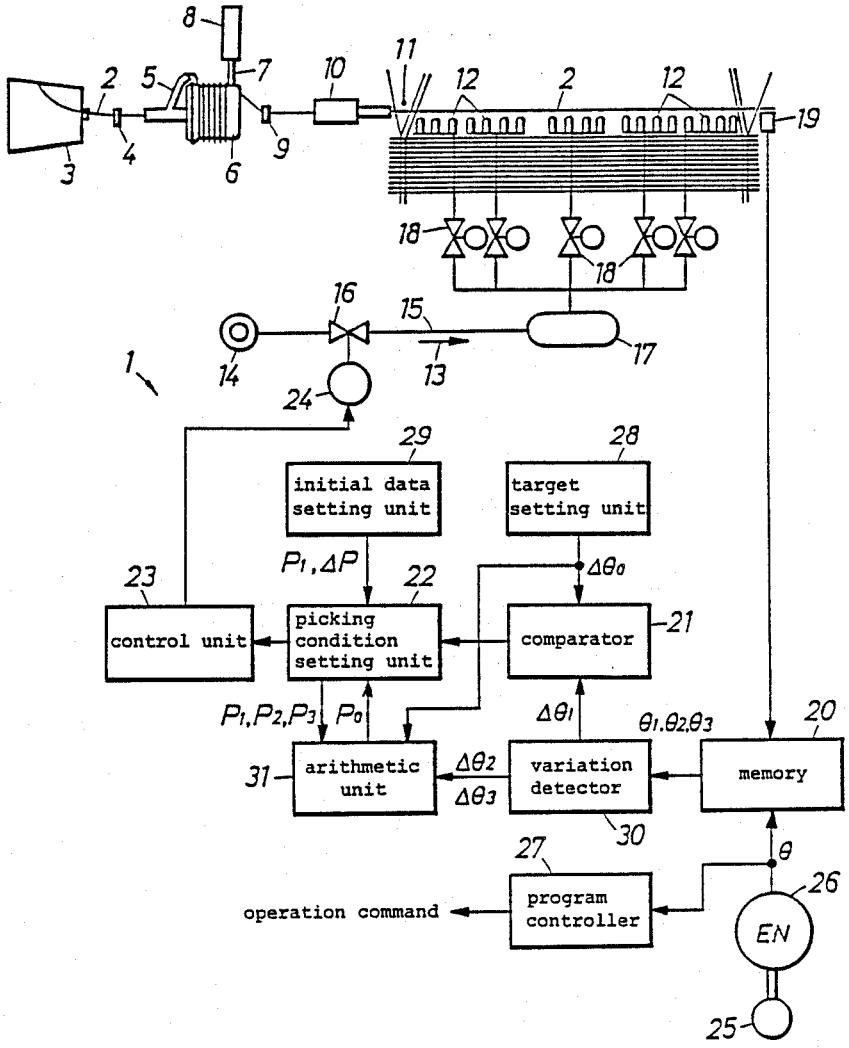
FIG. 1 is a block diagram of picking controller, in a preferred embodiment, according to the present invention.

FIG. 1 shows a picking controller 1 of the present invention in relation to the picking system of an air jet loom. A weft yarn 2 unwound from a supply package 3 is guided by a balloon control guide 4 into the interior of a rotary yarn guide 5. The rotary yarn guide 5 rotates relative to a storage drum 6 for measuring the length of the weft yarn 2 and storing the measured weft yarn 2 thereon to measure the length of the weft yarn 2 and to wind the weft yarn 2 around the storage drum 6. A stopping pin 7 holds the weft yarn 2 on the storage drum 6 while the rotary yarn guide 5 is rotating for measuring and winding the weft yarn 2 on the storage drum 6. The stopping pin 7 is operated by an actuator 8 so as to be retracted from the circumference of the storage drum 6 at the start of a picking operation to release the weft yarn 2 stored on the storage drum 6. The free end of the weft yarn 2 is passed via a yarn guide 9 through a main picking nozzle 10.

Upon the retraction of the stopping pin 7 at a picking time, the main picking nozzle 10 jets compressed air to pick the weft yarn at a predetermined running speed into a shed 11 by the agency of an air current. While the picked weft yarn 2 is running along a picking path, a plurality of groups of subnozzles 12 jet compressed air 13 in the picking direction to help the picked weft yarn 2 run in the picking direction. The compressed air 13 supplied from a compressed air source 14 is accumulated in an accumlator 17 and is distributed through shutoff valves 18 to the subnozzles 12 of the groups. A pressure regulating valve 16 provided in a line 15 connecting the compressed air source 14 to the accumulator 17 adjusts the pressure of the compressed air 13 to an appropriate pressure. The arrival of the free end of the picked weft yarn 2 at a selvedge on the arriving side is detected by a weft yarn arrival detector 19.

The weft yarn arrival detector 19, a memory 20, a variation detector 30, a comparator 21, a picking condition setting unit 22, a control unit 23 and a valve operating unit 24 for operating the pressure regulating valve 16 are connected sequentially in that order. A phase angle detector 26 detects the phase angle $\theta$ of the crankshaft of the air jet loom and provides a signal representing the detected phase angle to the memory 20 and a program controller 27. A target setting unit 28 is connected to the comparator 21 and an arithmetic unit 31. An initial data setting unit 29 is connected to the picking condition setting unit 22. The variation detector 30 is connected at the output side thereof to the arithmetic unit 31. The arithmetic unit 31 and the picking condition setting unit 22 are interconnected bilaterally.

While the air jet loom is in operation, the program controller 27 detects the phase angle $\theta$ and the number of rotations of the crankshaft 25 and executes a predetermined program. The program controller 27 provides an operation command once every predetermined number of picking cycles or every predetermined time interval to sequentially actuate the memory 20, the comparator 21, the picking condition setting unit 22, the variation detector 30 and the arithmetic unit 31. Before starting the air jet loom, the target setting unit 28 sets a target variation $\Delta\theta_0$, and the initial data setting unit 29 provides an initial jet pressure $P_1$ and a jet pressure adjusting step $\Delta P$. Accordingly, the picking condition setting unit 22 provides a command to the control unit 23 to adjust the pressure regulating valve 16 to provide the initial jet pressure $P_1$ at the start of the air jet loom.

Figure 2:
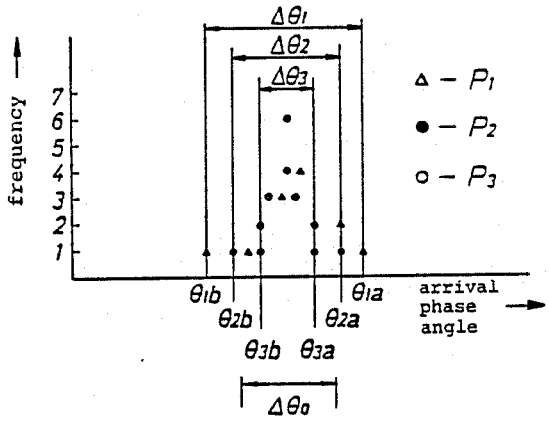
FIG. 2 is graph showing the respective frequencies of arrival phase angles.
Figure 3:
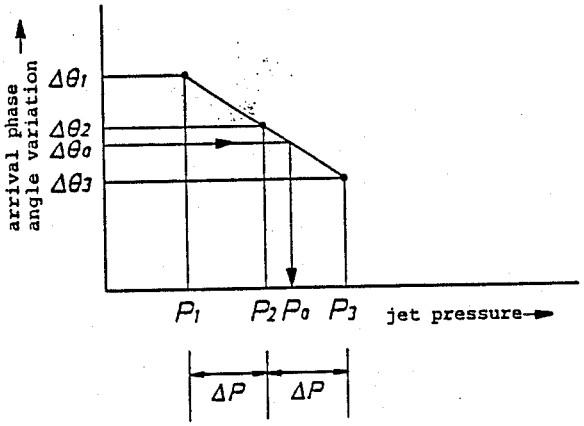
FIG. 3 is a graph showing the relationship between the jet pressure of the subnozzles and the actural arrival phase angle variation.

While the air jet loom is in operation, the subnozzles 12 jet compressed air at the initial jet pressure $P_1$ to help the weft yarn 2 picked by the main picking nozzle 10 run along the picking path. The weft yarn arrival detector 19 detects the actual arrival phase angle $\theta_1$ of the picked weft yarn 2. The detected actual arrival phase angle is stored in the memory 20. FIG. 2 shows the respective frequencies of arrival phase angles $\theta_1$, $\theta_2$ and $\theta_3$ respectively for jet pressures $P_1$, $P_2$ and $P_3$. In FIG. 2, frequency is measured on the vertical axis in a unit of twelve picking cycles. Upon the reception of an operation command from the program controller 27, the memory 20 stores the actual arrival angle $\theta_1$ every picking cycle while the variation detector 30 calculates an actual arrival phase angle variation in arrival phase angles $\theta_1$ stored in the memory 20, for example, by using an expression:

$$\Delta\theta_1=\theta_{1a}-\theta_{1b}$$

where $\Delta\theta_1$ is an actual arrival phase angle variation, $\theta_{1a}$ is the maximum arrival phase angle, and $\theta_{1b}$ is the minimum arrival phase angle.

Then, the program controller 27 provides a signal to actuate the comparator 21 every predetermined period, for example, every twelve picking cycles, to compare the actual arrival phase angle variation $\Delta\theta_1$ with a target arrival phase angle variation $\Delta\theta_0$. Then, the comparator provides a positive signal, a negative signal or a zero signal depending on the result of the comparison to the picking condition setting unit 22. When the deviation of the actual arrival phase angle variation $\Delta\theta_1$ from the target arrival phase angle variation $\Delta\theta_0$ is within a fixed range, the comparator 21 provides a zero signal to the picking condition setting unit 22, and then the picking condition setting unit 22 decides that no picking condition adjustment is necessary and maintains the initial jet pressure $P_1$ for subnozzles 12.

When the actual arrival phase angle variation $\Delta\theta_1$ is greater than the target arrival phase angle variation $\Delta\theta_0$, the comparator 21 provides a positive signal to the picking condition setting unit 22, and then the picking condition setting unit 22 raises the present jet pressure $P_1$ by the jet pressure adjusting step $\Delta P$ to set a new jet pressure $P_2$ for the subsequent twelve picking cycles. While the subnozzles 12 are operating at the jet pressure $P_2$, the memory 20 sequentially stores the actual arrival phase angles $\theta_2$ of the picked weft yarns 2. Then, the variation detector 30 sequentially calculates, in a manner similar to the foregoing manner of calculation, actual arrival phase angle variations $\Delta\theta_2$ by using an expresson:

$$\Delta\theta_2=\theta_{2a}-\theta_{2b}$$

After a predetermined number of picking cycles have successively been carried out, the program controller 27 provides a command to the picking contition setting unit 22 to raise the jet pressure further by the jet pressure adjusting step $\Delta P$ to set the jet pressure at a new jet pressure $P_3$. Subsequently, the subnozzles 12 operates at the jet pressure $P_3$ for the following twelve picking cycles, during which the memory 20 store actual arrival phase angles $\theta_3$ sequentially and the variation detector 30 detects actual arrival phase angle variation $\Delta\theta_3$ successively by using an expression:

$$\Delta\theta_3=\theta_{3a}-\theta_{3b}$$

and provides detection signals to the arithmetic unit 31.

Naturally, the jet pressures $P_1$, $P_2$ and $P_3$ are in a jet pressure range within which the jet pressure can be varied without causing sigificant variation in the dynamic position of the picked weft yarn 2. When the actual arrival phase angle variation $\Delta\theta_1$ is smaller than the target arrival phase angle variation, the picking condition setting unit 22 receives a negative signal and reduces the jet pressure $P_1$ by the jet pressure adjusting step $\Delta P$ every reception of the negative signal.

Upon the completion of a series of pressure control operations, the program controller 27 provides a command to the arithmetic unit 31 to make the arithmetic unit 31 determine the relationship between the jet pressure and the arrival phase angle variation, and then determines an optimum jet pressure $P_0$ on the basis of the relationship between the jet pressure and the arrival phase angle variation through an arithmetic operation using an expresson:

$$P_0=(\Delta\theta_1-\Delta\theta_0)(P_3-P_1)/(\Delta\theta_1-\Delta\theta_3)+P_1$$

Subsequently, the picking condition setting unit 22 drives the control unit 23 so that the control unit 23 controls the pressure regulating valve 16 to provide the optimum jet pressure $P_0$. Thus, the optimum jet pressure $P_0$ is set automatically for the subnozzles 12. Although the relationship between the jet pressure and the arrival phase angle variation is assumed to be represented by a straight line in this embodiment, the relationship between the jet pressure and the arrival phase angle variation can be determined on the basis of a plurality of measured data even if the relationship between the jet pressure and the arrival phase angle variation assumes a curve.

Thus, the picking operation is controlled periodically even during a trial weaving operation as well as during a practical weaving operation. A jet pressure adjusting step $\Delta P$ for a trial weaving operation is greater than that for a practical weaving operation.

Although the jet pressure is regulated, in this embodiment, to regulate the picking condition of the subnozzles 12, the jet duration of the subnozzles 12 may be regulated by varying the jet start phase angle, the jet end phase angle or both the jet start phase angle and the jet end phase angle. Since the jet duration is related to the flow rate of the compressed air 13, the flow rate of the compressed air 13 may be employed as a controlled variable. When the flow rate of the compressed air is employed as a controlled variable, the control unit 12 controls the shutoff valves 18 instead of the pressure regulating valve 16.

Although a series of control operations is started, in this embodiment, upon the completion of a predetermined number of picking cycles or upon the passage of a predetermined time, the control operation may be started upon an increase of the actual arrival phase angle variation to a value beyond allowable range of target arrival phase angle variations. In the latter case, the comparator 21 continuously compares the actual arrival phase angle variation with the target arrival phase angle variation, and actuates the program controller 27 upon the increase of the actual arrival phase angle variation to a value beyond the target arrival phase angle variation. Furthermore, the arrival phase angle variation is represented, in this embodiment, by the difference between the maximum and minimum arrival phase angles among those detected by the weft yarn arrival detector; however, the arrival phase angle variation may be represented by the standard deviation of the detected arrival phase angles.

Although the components of the picking controller 1 of the present invention are indicated by separate function blocks as a matter of convenience to facilitate the understanding of the explanation, the memory 20, the comparator 21, the picking condition setting unit 22 the program controller 27, the variation detector 30 and the arithmetic unit 31 among the components of the picking controller 1 may be the memory unit, arithmetic unit and control unit of a computer used for the control operation.

Although the invention has been described in its preferred embodiments with a certain degree of particularity, the present invention is not limited thereto in its practical application and it is to be understood by those skilled in the art that many changes and variations are possible in the invention without departing from the scope and spirit thereof.

What is claimed is:

1. A picking controller for an air jet loom having a main picking nozzle which jets air to pick a weft yarn into a shed, and groups of subnozzles which jet air to help the picked weft yarn run along a picking path, which comprises:

a phase angle detector for detecting the phase angle of the air jet loom;

a weft yarn arrival detector for detecting the arrival of the free end of the picked weft yarn at an arrival position;

a memory for storing actual arrival phase angles of the picked weft yarns in relation to the phase angle of the air jet loom;

a variation detector for determining arrival phase angle variations on the basis of the actual arrival phase angles detected in a predetermined period of time or in a predetermined number of picking cycles;

a comparator which compares the phase angle variations with a predetermined target phase angle variation and provides a signal representing the result of comparison;

a picking condition setting unit for sequentially varying a picking condition of the groups of subnozzles according to the signal representing the result of comparison given thereto from the comparator;

a control unit which controls the picking condition of the groups of subnozzles according to a command given thereto from the picking condition setting unit; and an arithmetic unit which determines the correlation between picking condition and arrival phase angle on the basis of the actual arrival phase angle variations, and then determines a picking condition corresponding to the target arrival phase angle variation on the basis of the correlation between picking condition and arrival phase angle.

2. A picking controller for an air jet loom, according to claim 1, wherein the memory, the comparator, the picking condition setting unit, the variation detector and the arithmetic unit are included in a computer used for control operation.

3. A picking controller for an air jet loom, according to claim 1, wherein said picking controller is the jet pressure of the groups of subnozzles, the jet duration of the groups of subnozzles or the flow rate of air supplied to the groups of subnozzles.

* * * * *